United States Patent [19]

Brumlik

[11] 4,180,890

[45] Jan. 1, 1980

[54] LINEAR ELEMENT WITH GRAFTED NIBS AND METHOD THEREFOR

[75] Inventor: George C. Brumlik, Montclair, N.J.

[73] Assignee: Ingrip Fasteners, Inc., Montclair, N.J.

[21] Appl. No.: 793,652

[22] Filed: May 4, 1977

Related U.S. Application Data

[63] Continuation of Ser. No. 625,278, Oct. 23, 1975, which is a continuation of Ser. No. 401,084, Sep. 26, 1973, Pat. No. 3,922,455, which is a continuation of Ser. No. 256,068, Oct. 23, 1972, abandoned.

[51] Int. Cl.[2] ..... A44B 17/00; D02G 3/00; B05D 1/24

[52] U.S. Cl. ..... 24/204; 427/185; 427/202; 427/204; 427/205; 427/206; 428/85; 428/86; 428/99; 428/372; 428/400

[58] Field of Search ..... 57/140 J, 140 C, 140 G; 428/85, 86, 99, 100, 364, 370, 372, 397, 90, 92, 101, 102, 400, 392; 24/204, 204 R; 427/185, 202, 204, 205, 206

[56] References Cited

U.S. PATENT DOCUMENTS

| | | | |
|---|---|---|---|
| 2,395,157 | 2/1946 | Work et al. | 427/185 |
| 3,775,228 | 11/1973 | Leary | 428/392 |
| 3,993,806 | 11/1976 | Athey | 428/90 |

*Primary Examiner*—William J. Van Balen
*Attorney, Agent, or Firm*—Sprung, Felfe, Horn, Lynch & Kramer

[57] ABSTRACT

Linear elements such as filaments having grafted nibs are disclosed. The grafted nibs are generally fibrils and/or scales which can be flexible or rigid. The nibs can be randomly grafted onto the linear element or they can be inclined or oriented in one direction so as to offer relatively little resistance to penetration into a material and greater resistance to pulling out. The linear element with grafted nibs can be twisted or spun into a yarn or it can be used as a yarn component. The linear element with grafted nibs or a yarn thereof can be used as a non-slip thread, as laces, and the like or they can be a component of woven and non-woven articles.

Also disclosed is a method for making the linear elements having a plurality of nibs physically bonded thereto. A substantially linear element such as a thread, a wire, a monofilament, a yarn, a ribbon or the like is contacted with a static or agitated mass of nibs thereby causing same to become physically bonded to the linear element. If desired, the linear element with nibs bonded thereto can be cut into discrete lengths which can be used as gripping elements in the manufacture of a multi-element self-gripping device for example.

17 Claims, 20 Drawing Figures

LINEAR ELEMENT WITH GRAFTED NIBS AND METHOD THEREFOR

This is a continuation of application Ser. No. 625,278, filed Oct. 23, 1975, which in turn is a continuation of application Ser. No. 401,084, filed Sept. 26, 1973 (now U.S. Pat. No. 3,922,455) which, in turn is a continuation of application Ser. No. 256,068, filed May 23, 1972 (now abandoned) which Ser. No. 401,084 carried forward disclosure from and was co-pending with Ser. No. 395,781, filed Sept. 10, 1973, which, in turn, was a continuation-in-part of Ser. No. 171,701 of Aug. 13, 1971, a continuation-in-part of Ser. No. 171,668 of Aug. 13, 1971, and a continuation of Ser. No. 295,637 of Oct. 6, 1972; and Ser. No. 256,068 having carried forward disclosure from and having been co-pending with said Ser. No. 171,701 of Aug. 13, 1971, and said Ser. No. 171,668 of Aug. 13, 1971.

BACKGROUND

This invention relates to linear elements having grafted nibs in relatively thick profusion and to a method for making same.

Most commercially available fibers, filaments and yarns are smoothly continuous and lack lateral projections. This smoothness imparts a lack of ability to resist motion within a medium of which they are a part or through which they pass. The smooth nature of commercial fibers, filaments and yarns including those made from plastics, metal and glass makes possible relative motion in both the forward and rearward directions along the longitudinal axis. This smoothness also limits the effect of space which a fiber, filament or yarn can occupy within a woven or non-woven article.

SUMMARY

The present invention provides linear elements which overcome the disadvantages of smooth fibers and filaments and which provide advantages and capabilities not possessed by conventional fibers and filaments.

The linear element of the invention comprises a substantially linear element such as a thread, a wire, a mono-filament, a yarn, a ribbon or the like having physically bonded thereto in relatively thick profusion a plurality of nibs such as fibrils and/or scales.

According to the method of the present invention a substantially linear element is contacted with a static or agitated mass of nibs thereby causing same to become physically bonded thereto. The nibs can be randomly bonded to the linear element or they can be oriented in one direction. The linear element with nibs bonded thereto can be cut into discrete lengths and in a preferred embodiment these lengths are used as gripping elements to form multi-element self-gripping devices which are also a part of the present invention.

The linear element with grafted nibs offers numerous advantages including an increase in bulk, resistance to motion due to the ability of the linear elements to interlock and if desired a preferential resistance to motion in one direction. Another advantage of the present invention resides in the fact that the linear element and grafted nibs can exist in an almost endless variety of combinations with respect to material, relative size, and shape, combinations of shapes, etc.

DESCRIPTION

The term "nibs" is used herein to generically describe scales, fibrils, piles, globules and the like or similar projecting or protruding bodies that can be pointed and/or rounded and/or uniformly or irregularly shaped. The edges of these bodies may be blunt or sharp and if pointed they may be blunt or sharp.

Figure 1:
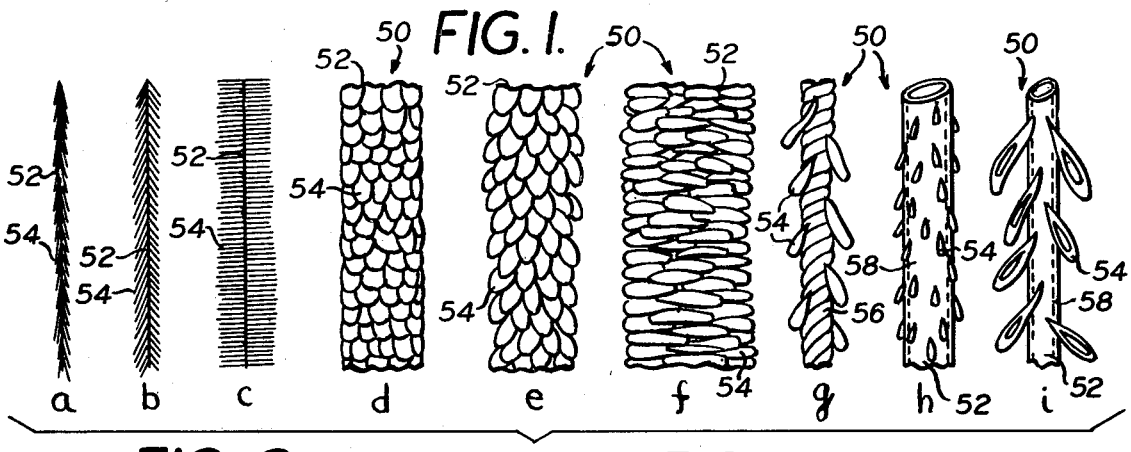
FIGS. 1*a–i* are side elevational views broken away showing segments of linear elements having fibrils and scales physically bonded thereto acccording to the present invention.

Referring now to the drawing, linear elements 50 are shown in FIG. 1 and include a linear member 52 having physically bonded thereto nibs 54 such as the fibrils illustrated in FIGS. 1*a–c* or the scales illustrated in FIGS 1*d–i*.

The linear members 52 can be made of metal, plastic or glass, or composites of any of these, and can be in the form of a wire or monofilaments as shown in FIGS. 1*a–c, h* and *i*, a ribbon as shown in FIGS. 1*d–f* or yarn 56 as shown in FIG. 1*g*. The nibs 54 can be readily bonded to the member 52 as illustrated in FIGS. 1*c* and *f* or they can be oriented in one direction so as to lay nearly flat against member 52 as illustrated in FIG. 1*a* and *d* or they can be oriented so as to be inclined or biased at any angle desired as illustrated in FIGS. 1*b, e, g, h* and *i*.

Figure 15:
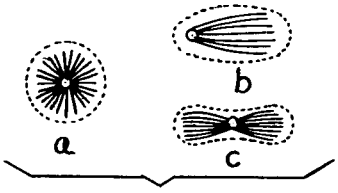
FIGS. 15*a–c* are cross-sectional views illustrating several ways in which the nibs can be laterally oriented with respect to the linear element.

The nibs 54 in addition to being oriented longitudinally can also be oriented laterally with respect to the linear member 52 as illustrated in FIGS. 15*a–c*. The dotted lines surrounding the views in FIG. 15 demonstrate several ways in which the grafted nibs can greatly increase bulk without unduly increasing weight.

Figure 4:
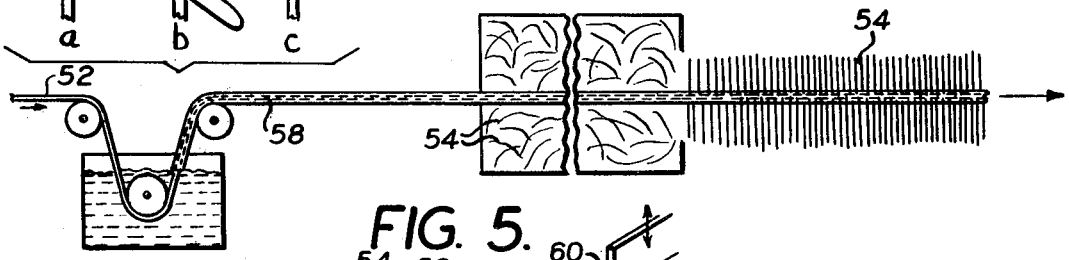
FIG. 4 is a diagrammatic view illustrating one embodiment of the method of the invention wherein a linear element is coated with an adhesive and thereafter contacted with a mass of nibs.

Referring now to FIG. 4, the elements 50 can be conveniently made in a continuous fashion by passing a substantially continuous linear member 52 through a mass of nibs 54, and in this illustration the nibs 54 become physically bonded to member 52 by reason of the adhesive coating 58 applied to the member 52 by passing same through an adhesive band as shown before coated member 52 contacts the mass of nibs 54.

Figure 5:
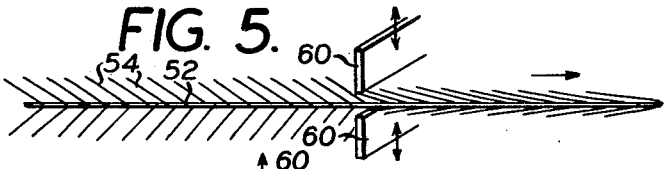
FIG. 5 is a diagrammatic view illustrating one way in which nibs can be biased or oriented after being physically bonded to a linear element.
Figure 6:
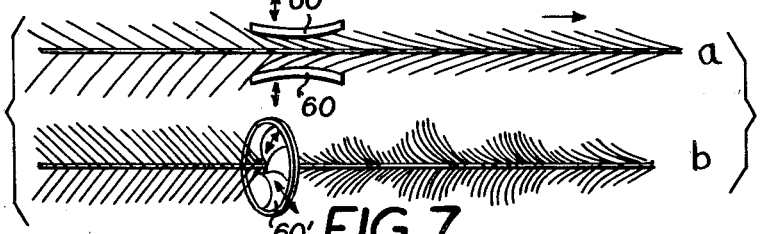
FIGS. 6*a* and *b* are also diagrammatic views illustrating two further ways in which nibs can be biased or oriented after being physically bonded to a linear element.

As the member 52 exits from the mass of nibs 54, the nibs 54 have become physically bonded thereto by means of the adhesive coating 58. As illustrated in FIG. 4, nibs 54 can be randomly bonded to the coated member 52. If desired, the member 52 with nibs 54 bonded thereto can be post-treated by being passed through a variable opening or gates which will orient the nibs 54 in one direction. FIGS. 5 and 6*a–b* illustrate several suitable arrangements for orienting the nibs 54 utilizing pairs of gate members 60 or a variable iris 60'. The pairs of gate members 60 and the iris 60' shown in FIGS. 5 and 6 can be used to obtain any desired configuration in orienting the nibs 54. For example, the gates 60 or iris 60' can be periodically closed against member 52 or repositioned or modulated with respect to member 52 to either orient and/or to remove nibs therefrom at spaced intervals or to create any desired oriented configuration as illustrated, for example, in FIG. 6*b* and in the several views shown in FIGS. 1 and 15.

Figure 10:
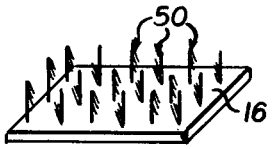
FIG. 10 is a perspective view illustrating a self-gripping device of the invention wherein discrete linear elements with grafted nibs are flocked onto a base.

By removing nibs at spaced intervals and orienting the nibs that remain inbetween and thereafter cutting the linear element, corresponding members having biased nibs 54 attached at one end can be obtained. Such a gripping element can be readily flocked onto a base in a statistical arrangement as shown in FIG. 10 and described in greated detail herein.

A unique feature of the present invention resides in the fact that there is control over all elements of the invention making it possible to produce an almost endless variety of linear members with grafted nibs. For example, there is control over the selection of the material, of construction, configuration, and or shape of the linear member 52 and the nibs 54. There is also control over the pattern in which the nibs 54 become physically bonded to the member 52 as well as control over the site on the nibs 54 at which they become bonded to the linear member 52. In addition, as discussed above, there is control over the angular inclination of the nibs 54 with respect to the member 52, both in the longitudinal and lateral directions as well as the angular orientation of the nibs 54 with respect to themselves.

Figure 14:
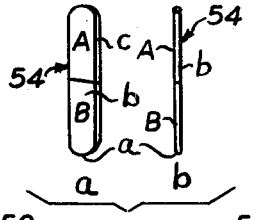
FIGS. 14*a* and *b* are side elevational views of nibs that can be utilized in the invention illustrating properties thereof and bonding sites.
Figure 17:
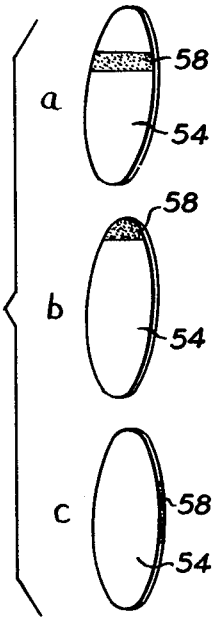
FIGS. 17*a–c* are side elevational views illustrating various ways in which an adhesive can be selectively applied to a nib to predetermine its bonding site with respect to a linear element.

In FIG. 14*a*, for example, a nib 54 in the form of a longitudinal scale is indicated as having bonding sites for attaching to the linear member 52 at its end a, on its flat face b or anywhere on its edge c. FIG. 17 illustrates how these bonding sites can be predetermined for the nibs 54 by selectively applying an adhesive coating 58 at any desired location on the nib 54 be it on the flat face, near the end or anywhere on the edge as illustrated in FIGS. 17*a–c*, respectively.

FIG. 14*b* shows a nib 54 in the form of a fibril having bonding sites at its ends a or anywhere inbetween for example at b as shown. Thus the bonding site for fibrils can be predetermined by the selective application of an adhesive in a manner similar to that shown for the scale-like nibs shown in FIG. 17.

Figure 16:
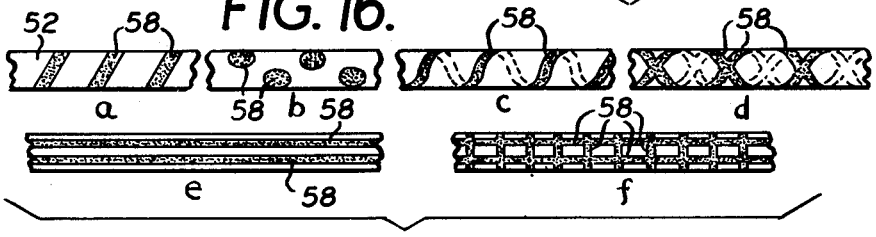
FIGS. 16*a–f* are side elevational views illustrating various ways in which an adhesive pattern can be applied to a linear element to provide a pre-determined pattern for physically bonding nibs thereto.

FIG. 16 illustrates several ways in which the pattern in which the nibs 54 become bonded to the linear member 52 can be controlled by the selective application of an adhesive to the linear member 52. For example, an adhesive 58 can be selectively applied in a random or uniform pattern to the member 52 using known printing, masking or similar techniques in the form of strips, spots, spirals, lengthwise stripes or a combination of lengthwise and lateral strips as illustrated in FIGS. 16*a–f*, respectively. In addition, in FIG. 16*d* the adhesive pattern can be formed from a combination of helixes rotating in the same or opposite directions and they can be further controlled to be in or out of phase to any controlled degree.

Referring again to FIG. 4, the mass of nibs 54 can be static or agitated, that is, kept in a constant state of motion. This can be accomplished using flocking, electrostatic, pneumatic, and similar means. For example, a vertical column can be used containing a fluidized bed of nibs 54 and the linear member 52 passed upwards through the fluidized bed. The nibs can be attached for example at their ends parallel to each other using any of these techniques.

Figure 2:
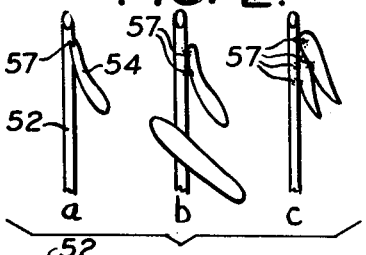
FIG. 2 is a side elevational view illustrating three ways in which nibs can be physically bonded to a linear element.
Figure 3:
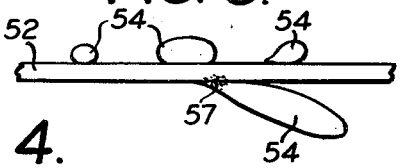
FIG. 3 is a side elevational view illustrating a further way in which the nib can be physically bonded to a linear element.

FIG. 2 illustrates nibs 54 in the form of scales secured at 57 at several sites on the nib 54 to the member 52 as well as to each other in an overlapping relationship. FIG. 3 illustrates a nib 54 in the form of a scale fused at 57 to the linear member 52.

As shown in several views of FIG. 1, the nibs 54 can be smaller than, equal to or larger than the diameter of the linear member 52. According to the invention, the nibs 54 are spaced randomly or uniformly in relatively thick profusion on the linear member 52. By this it is meant that for a given use or application of the linear element of the invention, there are sufficient numbers of grafted nibs to enable the linear element to function in the manner described herein. Thus the nibs are spaced in thick profusion relative to the manner in which the linear elements are used.

FIGS. 7*a–h* illustrate various shapes for the nibs 54 in the shape of scales while FIGS. 8*a–m* illustrate various shapes for the nibs in the form of fibrils. As noted above, there is complete control over the shape and characteristics of the nibs utilized and in this regard it should be noted that the grafted nibs bonded to a particular element may be all of the same type or may be a mixture of different kinds of nibs. The majority of the nibs shown in FIGS. 7 and 8 are self-explanatory and with respect to the nib shown in FIG. 7*e* it can be added that the particular shape shown is aerodynamic and such nibs will thus orient themselves when pneumatically contacted and bonded to a linear member. This is known as a canoeing effect that can be used to advantage in a flocking process. FIGS. 8*g* and *h* illustrate that the fibrils themselves can be composite and functional in shape.

In FIGS. 8*c, i, j, k* and *l* the particular configurations shown are also pile self-gripping elements having at least one bridge or connecting portion 80 which is capable of entering into self-gripping engagement with a gripping element. These pile elements can also have one or more gripping detents 82 and/or one or more windows 84, and are especially useful by themselves for flocking on a surface to form a highly functional multi-element pile in addition to being grafted to a linear element as described herein. The bridge 80 can be part of an open structure (FIG. 8*c* and *k*) or it can be a window 84 (FIG. 8*j*) or it can cross a longitudinal loop dividing it into a plurality of windows 84 (FIG. 8*a*) or it can be a crossing or meeting point (FIG. 8*l*).

Figure 20:
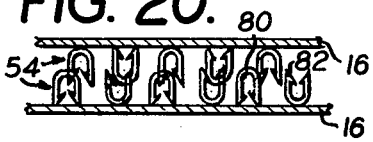
FIG. 20 is a side view in elevation of a multi-element device with a plurality of the pile elements of FIG. 8*c* attached upright to a base.

These pile elements can also be attached upright, for example by flocking using known techniques, to a base or surface to form a multi-element device. That is, in the case of the U-shaped element of FIG. 8*c* having gripping detents at the ends thereof, half will be flocked with the gripping ends down and the other half with the ends up as shown in FIG. 20. The same is true for the configuration of FIG. 8*j* having a gripping detent at the end of a lateral element joined to a closed loop. The symmetrical elements of FIGS. 8*k* and *l* can have gripping detents at one or both ends and can also be assembled into a self-gripping device. The longitudinal loop pile of FIG. 8*a* is symmetrical, non-irritating and is capable of engaging gripping elements at various levels.

Referring again to FIG. 4, any suitable type of adhesive or adhesive composition may be used to form the coating 58 shown in FIG. 4 or the selective applications illustrated in FIGS. 16 and 17. Suitable adhesives include hot melted adhesives, solvent activated adhesives, catalyzed room and elevated temperature hardening polymer adhesives, air hardening adhesives and the like.

Because the nibs and the linear element are initially formed independently of each other, a desirable molecular or crystalline orientation (e.g. axial or biaxial) can be obtained in either the nibs or the linear element or in both. For example, the linear element can be made of fiber forming linear polymers such as polyolefins, polyester, polyamides, and the like, and axially oriented while the nibs can be cut from axially oriented linear elements made from metals, plastics, glass or composite materials.

As noted in FIG. 3, it is possible to do away with an adhesive coating or selective application and simply heat the linear member 52 so that the nibs 54 will fuse to it and bond upon contact. To accomplish this the linear member and/or nibs must be made from a material capable of fusing or sealing upon the application of heat. Such materials include glass, plastics and metal. The linear member may be heated and/or the nibs heated to cause fusion or sealing upon contact. Heating can be accomplished by passing electrical current through a conducting linear member, by means of electromagnetic induction or by applying a secondary or external heat source.

Also shown in FIG. 3 are nibs 54 which can be formed from molten globules of metals, glass, and plastics. The globules can attach themselves to a heated linear element 52 and can remain generally spherical or they can be distorted while still pasty and soft to form elongated or tear drop shapes as shown by passing the linear element with globules attached through a viscous fluid or through a mass of metal shot sand or the like or by directing a blast of gas thereagainst.

In addition to the electrostatic and pneumatic means mentioned above for agitating a mass of nibs, electromagnetic, ultrasonic, vibratory, and electrical techniques may also be employed depending on the nature of the linear member and/or the nibs.

In addition to or in place of gate member 60 shown in FIGS. 5 and 6, it is also possible to use a comb-like device or variable iris (60' in FIG. 6*b*) to conform or orient the nibs.

Figure 9:
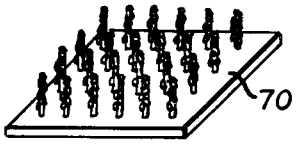
FIG. 9 is a perspective view illustrating a self-gripping device of the invention utilizing a linear element with grafted nibs of the invention cut into discrete lengths and attached in an upright fashion to a base.

FIG. 9 illustrates a self-gripping device utilizing a plurality of upright gripping elements 50, for example, as cut from the linear member of FIG. 1*h* and attached to a base 70.

In FIG. 10, flocked-on gripping elements 50 are attached to a base member 16 utilizing known techniques and, due to the nature of the flocking process, approximately half of the gripping elements are attached lower end down and the remaining elements are attached upper end down. However, because the gripping means are only attached adjacent one end of the stem, there is no interference with the self-gripping capabilities of the device.

Figure 11:
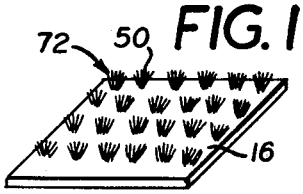
FIG. 11 is a perspective view of a self-gripping device of the invention wherein discrete linear elements with grafted nibs are tufted into a base.

In FIG. 11, gripping fibers 50, for example, any of those shown in FIG. 1, are tufted into or on base 16 using conventional techniques to form a plurality of gripping tufts 72 which can be uniformly or randomly arranged on the base 16. Because the individual gripping fibers 50 in the tufts 72 radiate in several directions, self-gripping engagement can take place at several angles resulting in cooperative or additive self-gripping action by the individual fibers 50 in each tuft 72.

As indicated previously, the nibs 54 are physically bonded to the member 52 by fusion, sealing or adhesively securing these gripping members to the member 52. The member 52 may be a monofilament made of natural or man-made fibers or it may be made of glass or metal or a composite of any of these materials. It may also be made of a plastic in the form of a thin rod or it may be a composite including plastic. It may also be a dimensioned or textured filament or trunk thread or yarn such as used for sewing, knitting, weaving and the like. It is also possible to form the member 52 and later make it rigid by fusion, adhesive coating, etc.

Figure 7:
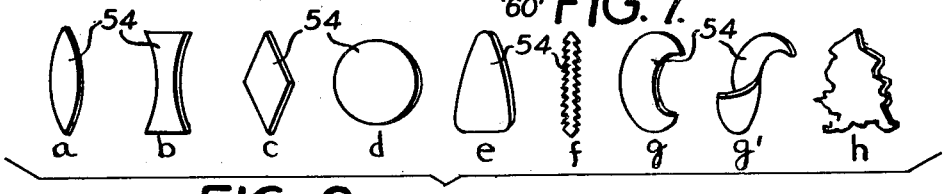
FIGS. 7*a–h* are side elevational views illustrating several embodiments for the nibs in the form of scales which can be physically bonded to a linear element.
Figure 8:
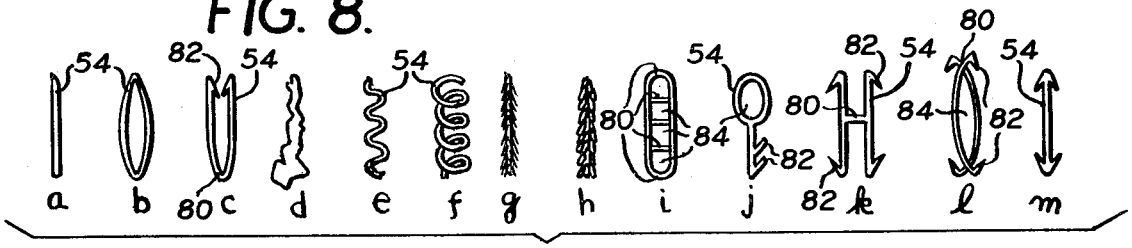
FIGS. 8*a–m* are side elevational views illustrating several embodiments for the nibs in the form of fibrils that can be physically bonded to a linear element.

Nibs in the form of fibrils and scales such as shown in FIGS. 7 and 8 may be made of metal in the form of short segments of wire, particles of foil or small shavings or other forms of fibrils or scales. They may be additionally made of plastic, glass, ceramics or a composite of the foregoing. The fibrils may be made from monofilament which may be stretched and oriented, they may be made from slit film or may be molded or extruded and cut to obtain any desired shape or form. The scales such as those shown in FIG. 7 may be cut from foil, cut from extruded forms, they may be punched, photo etched or photo formed from sheet materials or an extruded profile or they may be molded to obtain any desired shape or texture. The scales or fibrils may be laminated so as to have a shape which can be used as such or post-altered by mechanically, physically or chemically treating the fibrils or scales before or after physically bonding to the stem member 52. The fibrils and scales may also be twisted into convoluted or spiral forms of any desired hardness, pitch, convolutions and the like to obtain any desired geometrical form. This is illustrated in FIG. 7*g'*.

It is also within the scope of the present invention to utilize nibs having particular physical and/or optical properties and two or more such properties may be combined in a single nib as suggested in FIGS. 14*a* and *b* by the regions designated A and B. Thus the nibs may have ferro-magnetic, ferri-magnetic, antiferro-magnetic or piezoelectric properties. Linear elements having grafted nibs with properties such as these can thus be utilized as components in electronic devices.

The nibs used in the invention may also possess or have imparted thereto physical and/or optical properties such as absorption, reflection or dispersion of electromagnetic radiation resulting in patterns of color fluorescence, gloss, metallic sheen and other properties valuable in electronics such as spectroscopy and other instrumentation.

For example, a nib may have a predetermined pattern printed, etched, or otherwise formed on its surface or edge or even contained within its body. A magnetizable material such as barium ferrite can be used in the linear member or the nibs.

Either opposite faces of nibs can contrast or differ in properties and a flipping back and forth can result in a change which can be interpreted as a memory unit for a computer or similar signal or memory device. If the contrasts were in colors the linear element would be one color when punched or stroked in one direction and the opposite and different color when punched or stroked in the other direction.

The linear elements made according to the method of the invention as illustrated for example in FIG. 4 may be cut into gripping elements which are suitable for use in multi-element self-gripping devices as described herein by being attached in an upright fashion to a base which may be a line, a sheet or a point.

The elements shown in FIG. 1 for example are especially useful in forming asymmetrical self-gripping devices as are disclosed in detail in my copending application Ser. No. 171,701 filed Aug. 13, 1971, now abandoned, and in forming self-gripping devices having L-shaped gripping elements according to my copending application Ser. No. 186,874 filed Oct. 6, 1971, now abandoned.

Figure 18:
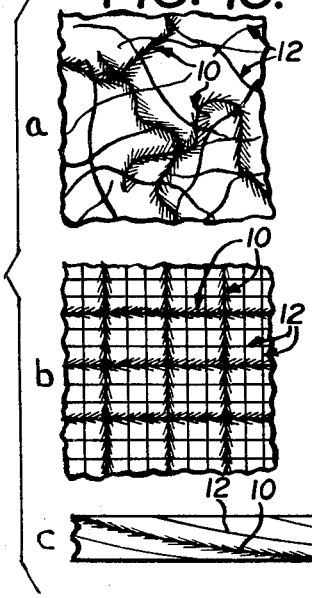
FIGS. 18*a–c* are diagrammatic views illustrating various ways in which a linear element with grafted nibs can be utilized as a component of non-woven and woven materials and yarn.
Figure 19:
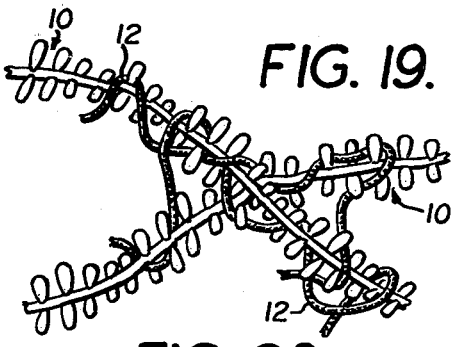
FIG. 19 is a diagrammatic view demonstrating one way in which linear elements with grafted nibs of the invention interlock with each other and the conventionally smooth filaments.

The elements as shown in FIG. 1 may also be used in other areas, for example as a component of fibers and fabrics, felts, filters, packing and insulating materials, porous plastics and as a material for reinforcing other materials such as plastics, plastic foams and the like resulting in greatly increased properties of tension and impact. FIG. 18*a* illustrates a linear element with grafted fibril-like nibs as a component part of a non-woven material while FIG. 18*b* shows a similar linear element incorporated into a woven material and FIG. 18*c* shows such a linear element incorporated into a twisted yarn. FIG. 19 illustrates the way in which linear elements of the invention with grafted nibs can interlock with each other as well as with a smooth filament. This type of interaction occurs, for example, in the various embodiments shown in FIG. 18. It is also possible by virtue of the interaction demonstrated in FIG. 19 to use the linear elements of the invention in waterless or other techniques of paper manufacture as well as a magnetic binder component.

A linear member with grafted nibs may also be used in sewing to produce a material which has different coefficients of friction in two directions. That is, a thread or lace would pull easier in one direction as compared to the opposite direction due to the orientation of the fibrils and/or scales physically bonded to the linear element. It is obvious that depending on the use for the elements as shown in FIG. 1 that they can range in size from extremely small to relatively large. The fibrils and/or scales attached to the member 52 may be ruffled or may be nearly flattened against the member 52. It is also possible to inscribe a helical pattern about the member 52 using a suitable tool to impose same. It is also understood that any number of fiblrils and/or scales of any varying size may be used in combination in the same element as to provide varying properties, etc. Thus a single fibril or scale may be used to form a somewhat homogeneous element or a hybrid mixture can be used to cover a single member 52.

FIGS. 18*a–c* illustrate various ways in which a linear element with grafted nibs indicated generally by reference numeral 10 can be incorporated into various structures with conventionally smooth filaments and fibers 12. In FIG. 18*a* the element 10 is shown as a component of a non-woven structure, in FIG. 18*b* as a component of a woven structure; and in FIG. 18*c* as a component of a yarn.

FIG. 19 is a greatly enlarged view showing one way in which linear elements with grafted nibs 10 interlock with each other and the conventially smooth filaments 12.

Referring now to FIGS. 9–13, the self-gripping device of the invention is shown to include a plurality of upright gripping elements 50 stiffly attached in thick profusion or in relatively close proximity to each other to a base such as a sheet or tape 70 shown in FIG. 9 or a disc-like patch or a linear element such as the filament.

The term generally upright is intended to include gripping elements inclined at an angle to the base for example from about 25° up to 90°. In some instances, it is preferred to incline the entire assembly of all the gripping elements at an angle relative to the base to promote self-gripping action or for particular applications for example where the self-gripping device is mounted on a vertical surface. It should also be noted that a plurality of gripping elements 50 such as shown in FIG. 9 for example, cooperate in gripping a receiving material and effectively distribute the force over a given area thus eliminating concentrations of stress. Combinations of gripping elements which vary in shape and/or size may also be utilized in the same device.

In FIG. 9–13, the upper ends of the gripping elements 50 can be characterized as having a penetrating profile or shape to facilitate penetration into a receiving material. This may be accomplished by any of the shapes illustrated in FIG. 1. In addition, flat stems can be cut at an angle or pointed, rounded or otherwise shaped. In those instances, where skin irritation is to be avoided, the upper end of the gripping elements 50 are preferably rounded.

As indicated above, the self-gripping elements of the device of the invention are adapted to penetrate and become lodged in a receiving material. The device of the invention is especially useful with receiving materials which comprises fibers, yarns, fibrils, filaments or thin walled cells, webs or sheets.

Thus, the self-gripping device of the invention is particularly adapted for self-gripping a wide variety of materials such as woven, non-woven and knitted fabrics, fibers and fiber aggregates, carpets, carpet-like materials, foamed rubber and plastics, felt, wood, cork, sponge, animal and artificial fur and hair, feathers, leather, paper, cardboard, corrugated cardboard, metal and plastic mesh, filter sheets, expanded and perforated sheet materials and composites of any of the foregoing.

The receiving material may also be a thin wall or lamina which is capable of being penetrated or pierced by the gripping element such as a sheet per se or an interior cellular wall; also included are web-like structures having thinned out or localized areas capable of being self-gripped. For example, such sheets can be a sheet with densely punched holes relatively close to each other or expanded sheets such as expanded metal.

Especially suitable receiving materials and structures are disclosed in my copending applications Ser. Nos. 126,708 and 126,706, both filed Mar. 22, 1971, and Ser. No. 154,589, filed June 18, 1971, both abandoned.

Figure 12:
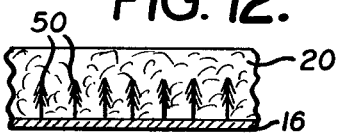
FIG. 12 is a side elevational view illustrating embodiments of the self-gripping device of the invention wherein a protective layer is utilized therewith or a hybrid gripping surface is provided.

Referring now to FIG. 12, a self-gripping device of the invention comprising a sheet 16 and upright gripping elements 50 is shown in self-gripping engagement with a receiving layer 20 which is shown to be fibrous in nature for purposes of illustration.

In certain applications, it is desirable to utilize a receiving layer such as that shown in FIG. 12 as a protective layer for the gripping elements 10 which can be stripped off to prepare the device for self-gripping engagement. The use of a protective layer makes it possible to ship and handle the gripping device of the invention without irritation to the user or premature self-gripping engagement. The protective layer may have a thickness equal to or greater than the height of the gripping elements 50. Such a protective layer can be readily utilized with any of the various embodiments of the invention such as those shown in FIGS. 9 through 13 for example.

It is also possible to use the receiving layer 20 as a component part of the device of the invention. In this instance the layer 20 is made of a resilient material such as felt, carpets, carpet-like materials, woven, non-woven and knitted fabrics and fibers, mats made of monofilaments or staple fibers in parallel, braided or random orientation, sponge, plastic and rubber foam and the like, the remains in place over the gripping elements 50 forming what can be called a hybrid self-gripping surface. The gripping elements 50 in this embodiment can extend below to or beyond the surface layer 20. Thus, when the layer 20 is compressed, the elements 50 are exposed and protrude out of the layer 20 and are then capable of self-gripping engagement with a receiving layer or material or a similar hybrid self-gripping device.

Figure 13:
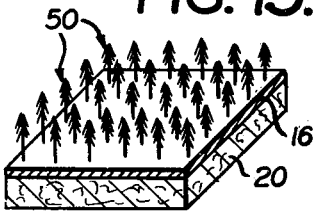
FIG. 13 is a perspective view illustrating a further embodiment of a self-gripping device of the invention.

In FIG. 13, a receiving material 20 described above is attached to the back of sheet 16 forming another hybrid type of device that can loop around and self grip itself or be gripped by other devices.

In general, the gripping elements are sufficiently stiff such that they resist deflection which would otherwise prevent them from penetrating and becoming lodged in a receiving layer or material. It is also necessary that the gripping elements be sufficiently stiffly attached to the base to enable the gripping elements to enter into self-gripping engagement. Thus, the gripping elements can be attached to a base by any suitable technique consistent with the nature of the gripping element and the base. The base itself can be fabricated from a wide variety of materials such as metal, wood, plastics, glass, paper, cardboard, porous, woven and non-woven materials and the like.

The gripping elements can be attached to the base by inserting the lower ends in a sheet, patch or strip such as shown in FIG. 9 and/or by mechanically attaching the gripping elements using, hot melt adhesives, tufting (as in FIG. 11), electrostatic and other flocking process, fibers laying followed by cutting and bending up, weaving, knitting, pulling out by needle felting, welding or heat sealing techniques. The gripping elements 50 may also be attached to base 16 in a staple-like fashion.

The gripping elements generally range in length from about 0.002 to about 0.75 inch. It should be noted that extremely small gripping elements can form the device of the invention and yet be invisible to the naked eye.

Plastics for the linear member 52 and for the nibs include both thermosetting and thermoplastic materials such as nylons, propylene polyesters, polyamides, polyacetals, polysulfones, polycarbonates, polyvinyl chlorides, polyethers, halogenated polymers, phenolic and melamine resins and the like. The member 52 can have any desired cross-sectional shape such as round, oval, flat and the like.

FIG. 20 illustrates a multi-element device formed by flocking the pile element of FIG. 8*c* onto a base 16. Because of the nature of the flocking operation, the pile elements are statistically attached to the base such that half are attached with the detents down and half are detached with the detents up. Similar multi-element devices can be formed utilizing the pile elements of FIGS. 8*b, i, j, k* and *l*, for example.

The self-gripping devices such as shown in FIGS. 9–13 may be used in a variety of ways to efficiently and quickly render virtually any surface or article self-gripping. The device of the invention can be readily used by individuals and commercial users to render selected areas of articles or entire articles self-gripping such as carpets, fabrics, felts, wall cladding materials, panels, tile, sheets, fibers, decorative trim, and the like. The self-gripping devices of the invention also find uses per se for example as conveyor belts and material separators and as a teasel for raising a nap on a woven or non-woven material.

What is claimed is:

1. A method of making filament which comprises heating a mass of heat softenable nibs which are capable of being fused to a monofilament, contacting a monofilament with a mass of said nibs while said nibs are in a heat softened condition and bonding said nibs to said monofilament to form a composite filament comprising grafted nibs fused to said monofilament.

2. A method of claim 1 wherein the said nibs are short textile filaments.

3. A method of claim 1 wherein said nibs are scales.

4. A method of claim 1 wherein said mass of nibs is static.

5. A method for making self-gripping devices comprising tufting composite filaments made according to claim 1 and tufting said filaments to a base.

6. A composite filament consisting of organic polymers comprising a central monofilament trunk to which short nibs of different composition from the filament trunk are grafted in a transverse orientation in a close proximity to one another.

7. A composite filament according to claim 6 wherein the said nibs are short fibers.

8. A composite filament according to claim 7 wherein said short fibers are attached to the inner linear member at one of their ends.

9. A composite filament according to claim 8 in which said short fibers are oriented in parallel.

10. A composite filament according to claim 6 in which the said nibs are in a slanted position with respect to the inner linear member.

11. A composite filament according to claim 7 in which the short fibers are of an undulating or coiled form.

12. A yarn comprised at least in part of a plurality of filaments according to claim 6.

13. A yarn comprised at least in part of a plurality of composite filaments of claim 7.

14. A yarn comprised at least in part of a plurality of filaments of claim 8.

15. A non-woven fabric comprised at least in part of a mass of filaments according to claim 6.

16. A self-gripping device comprising short segments of the composite of claim 6, wherein the said short segments are bonded to a base.

17. A self-gripping device comprising composite filaments of claim 6 tufted to a base.

* * * * *

UNITED STATES PATENT AND TRADEMARK OFFICE

CERTIFICATE OF CORRECTION

PATENT NO. : 4,180,890
DATED : January 1, 1980
INVENTOR(S) : GEORGE C. BRUMLIK

It is certified that error appears in the above-identified patent and that said Letters Patent are hereby corrected as shown below:

In the title page, under RELATED U.S. APPLICATION DATA, the date for Serial No. 256,068 should be --May 23, 1972-- and not "October 23, 1972."

Signed and Sealed this
*Tenth* Day of *June 1980*

[SEAL]

*Attest:*

SIDNEY A. DIAMOND

*Attesting Officer*

*Commissioner of Patents and Trademarks*